United States Patent [19]

Diederich et al.

[11] Patent Number: 4,711,429

[45] Date of Patent: Dec. 8, 1987

[54] TUNDISH FOR MIXING ALLOYING ELEMENTS WITH MOLTEN METAL

[75] Inventors: David J. Diederich; John C. Paddock, both of Lorain, Ohio

[73] Assignee: USX Corporation, Pittsburgh, Pa.

[21] Appl. No.: 901,843

[22] Filed: Aug. 29, 1986

[51] Int. Cl.[4] ..... B22D 41/08

[52] U.S. Cl. ..... 266/44; 266/275; 164/337

[58] Field of Search ..... 266/275, 216, 44, 45; 164/335, 437, 438, 468; 222/603, 606, 594

[56] References Cited

U.S. PATENT DOCUMENTS

| | | | |
|---|---|---|---|
| 4,042,229 | 8/1977 | Eccleston | 266/275 |
| 4,524,819 | 6/1985 | Yoshimura | 164/468 |

FOREIGN PATENT DOCUMENTS

| | | | |
|---|---|---|---|
| 2250594 | 6/1975 | France | 164/437 |
| 0027174 | 9/1979 | Japan | 164/437 |
| 7927174 | 9/1979 | Japan . | |
| 0010312 | 1/1980 | Japan | 164/437 |
| 7882119 | 1/1980 | Japan . | |
| 0031452 | 2/1982 | Japan | 164/437 |
| 5731452 | 2/1982 | Japan . | |
| 0103111 | 11/1983 | Japan . | |
| 0103113 | 11/1983 | Japan . | |
| 0212848 | 12/1983 | Japan | 164/437 |
| 0127055 | 12/1983 | Japan . | |
| 2159741 | 12/1985 | United Kingdom | 164/437 |

OTHER PUBLICATIONS

*The Making Shaping and Treating of Steel,* pp. 87–90, 10th edition, 12/85.

*Primary Examiner*—L. Dewayne Rutledge
*Assistant Examiner*—S. Kastler
*Attorney, Agent, or Firm*—William F. Riesmeyer, III

[57] ABSTRACT

A tundish is provided with a mixing zone below an entry station where a stream of molten metal from a ladle enters the tundish. The mixing zone utilizes the force from the ladle stream to create sufficient turbulence for mixing alloying elements, particularly alloying elements such as lead having density greater than that of the molten metal with the metal in the tundish. The invention also includes a process for uniformly mixing alloying element with molten metal in the tundish. The process is particularly suited to making lead-bearing free machining steels on a continuous caster.

3 Claims, 2 Drawing Figures

TUNDISH FOR MIXING ALLOYING ELEMENTS WITH MOLTEN METAL

TECHNICAL FIELD

This invention relates to an improved tundish designed to promote mixing of alloying elements with molten metal therein, and particularly to an improved tundish for promoting mixing into the molten metal alloying elements having a density greater than that of said molten metal.

BACKGROUND ART

In the manufacture of free-machining steels containing lead, it is very difficult to obtain uniform lead distribution in the solidified steel product. The difficulty is primarily due to the lead having a higher density than molten steel, requiring thorough mixing of lead with the steel and causing rapid settling and segregation of the lead before steel solidification is complete. To minimize settling within the steel, lead has been added as close to the time of solidification as possible. In ingot practice, lead has been injected into the stream between the ladle and the mold. For continuous cast product, lead has been added directly to the mold as disclosed in U.S. Pat. No. 4,524,819 or in the tundish as in J 60103111, J 60127055, J 60103112, J 603113 and J 59113156. It is difficult to obtain uniform mixing when making the lead addition to the caster mold, while, on the other hand, segregation tends to occur when the addition is made to the tundish.

It is a primary object of this invention to provide a tundish of improved design for promoting mixing of lead with the molten metal therein and minimizing the degree of lead segregation prior to delivery of molten metal into the mold.

It is a further object of the invention to provide a process for mixing alloying elements with molten metal using the improved tundish just mentioned.

DISCLOSURE OF INVENTION

A conventional tundish has outer walls defining a cavity for containing a predetermined volume of molten metal at a specified depth and which is to be supplied from the tundish to a casting mold. The tundish has a first outlet opening for draining molten metal from the tundish into the casting mold. The tundish also has an entry station for receiving a stream of molten metal from a ladle. The entry station has a vertical axis at the point of impact of the ladle stream with molten metal in the tundish which is displaced horizontally from the vertical axis of said first outlet opening in the tundish.

According to this invention, an improvement is provided in a tundish which is characterized by said tundish having a mixing zone directly below said receiving station. The mixing zone includes a generally vertical first inner wall extending upwardly from a bottom surface of the tundish cavity to a height which is at least forty percent of the specified depth of molten metal in the tundish. The first inner wall extends transversely to the direction of flow of molten metal from the entry station to the first outlet opening. The first inner wall defines at least a portion of the lower periphery of at least one opening for flow of molten metal from said entry station to the first outlet opening. The lower periphery of each opening in the inner wall is at a height not less than forty percent of the specified depth of molten metal in the tundish. The aggregate cross-sectional area of said opening in the first inner wall are not less than the cross-sectional area of the first outlet opening. The first inner wall is spaced from the vertical axis of the entry station a distance within the range of 20 to 65 cm in a direction normal to the first inner wall. The mixing zone includes another wall essentially parallel to the first inner wall located substantially the same distance from the vertical axis of the entry station as said first inner wall in a direction normal thereto and remote therefrom. The mixing zone also includes a pair of spaced generally vertical walls joining said first inner wall and said other wall. Preferably, the volume of said mixing zone below the periphery of the opening in said first inner wall is at least about equal to the volume of molten metal flowing through said first outlet opening into the casting mold over a time period 60 seconds in duration. The mixing zone utilizes the force of the stream from the ladle at the entry station to cause uniform mixing of said alloying element with the molten metal.

BEST MODE OF CARRYING OUT THE INVENTION

Figure 1:
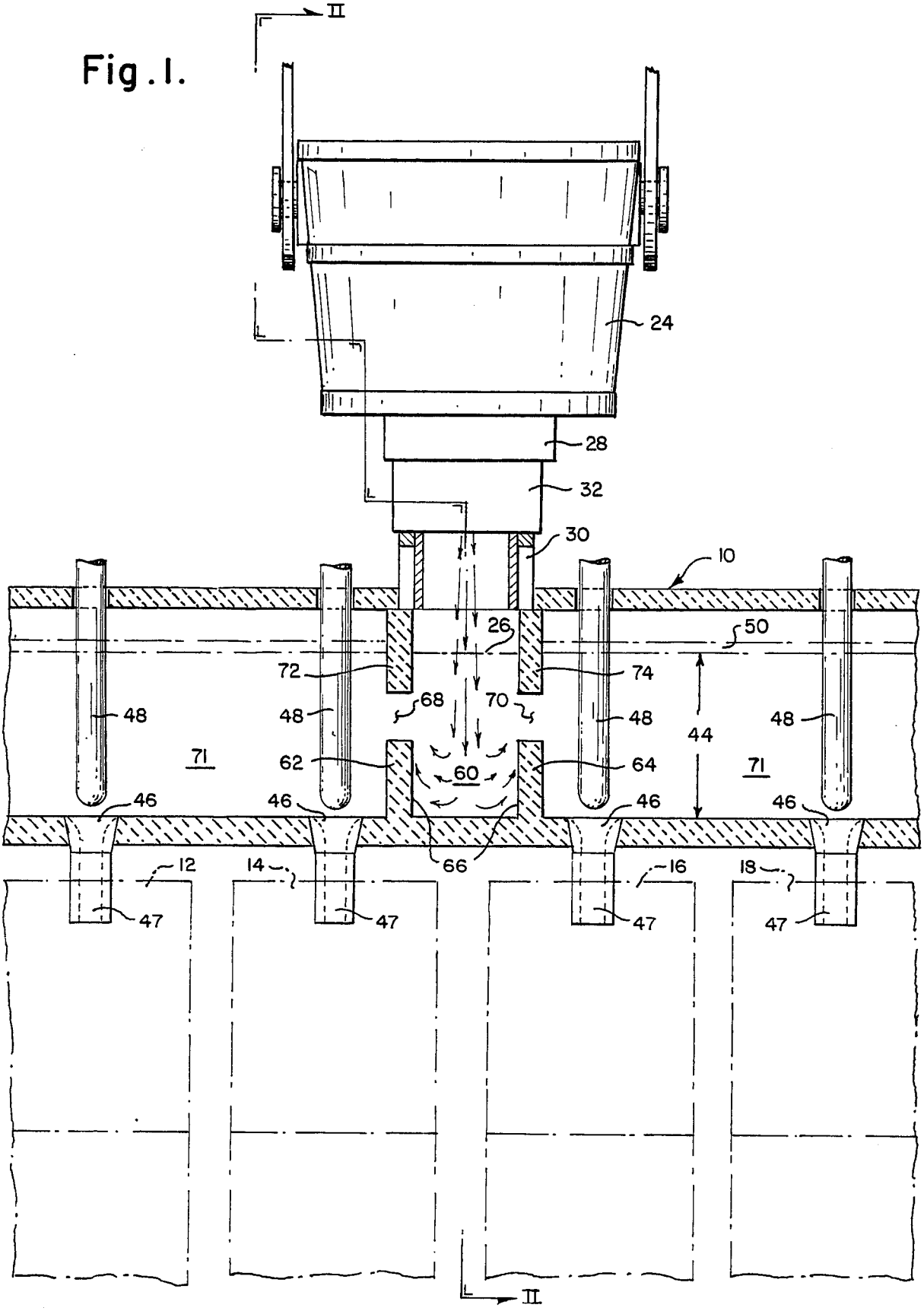
FIG. 1 is a front elevational view partly in section of the improved tundish of this invention showing a ladle and continuous caster molds in relation thereto.
Figure 2:
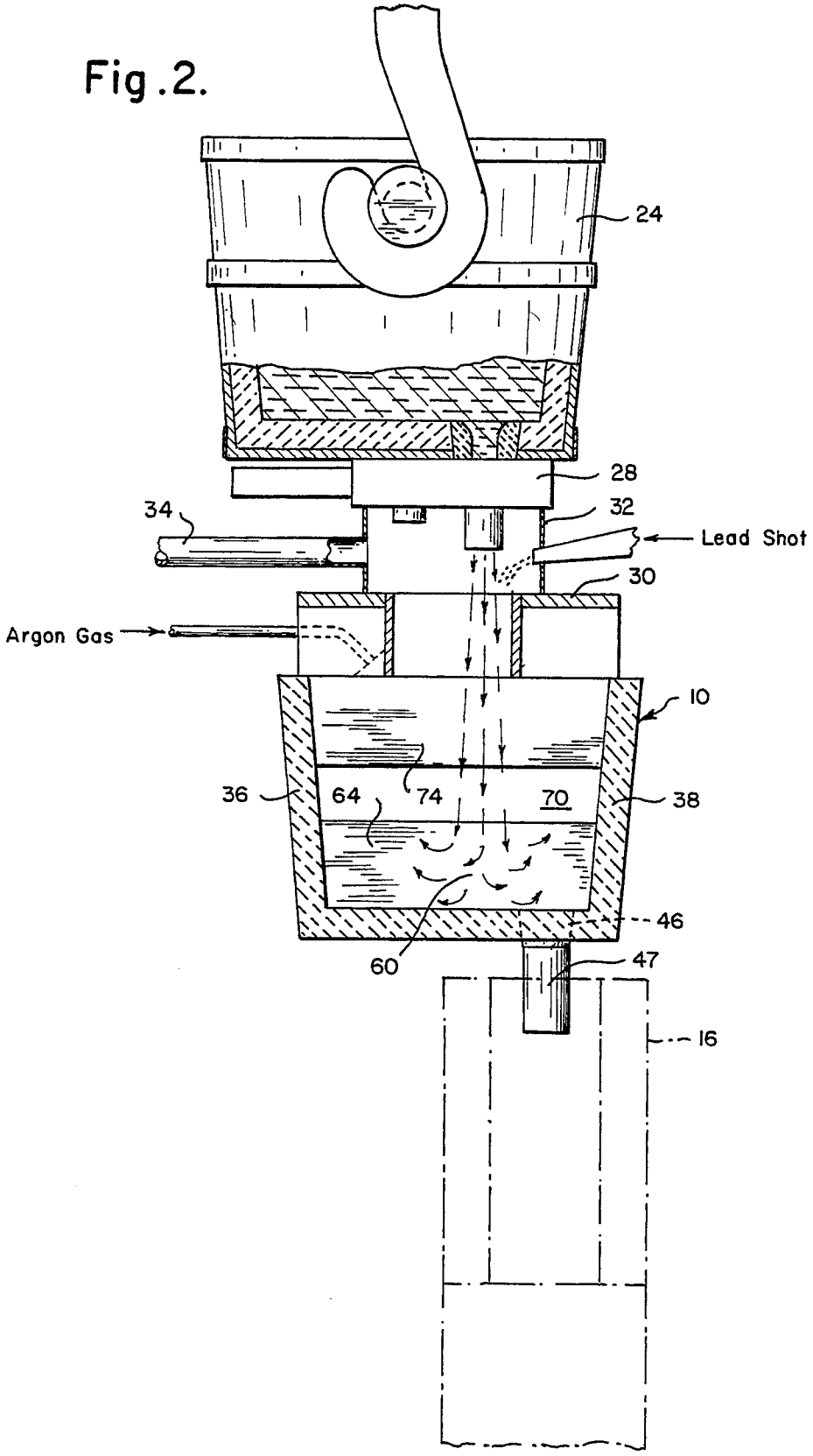
FIG. 2 is a section taken at II—II of FIG. 1.

Referring to FIG. 1, tundish 10 is mounted directly above a plurality of continuous caster billet molds illustrated schematically at 12, 14, 16 and 18 (FIG. 1). Ladle 24 containing a heat of molten metal to be cast is positioned above the tundish. Molten metal is delivered from the ladle to an entry station 26 of the tundish in a stream controlled by slide gate valve 28 on the ladle. For purposes of the claims, the entry station specifically refers to the point defined by the intersection of the vertical axis of the ladle stream with the surface of the molten metal in the tundish at the point of impact of the stream with the metal therein. Generally, the entry station is centrally located between opposed walls of the tundish as described more fully hereinbelow. The space between the ladle and the tundish surrounding the stream is enclosed by a fabricated cover 30 on the tundish and a shroud 32 extending between the cover and the ladle. Inert gas preferably argon is supplied at inlet 32 to the enclosure surrounding the ladle stream through cover 30 or as to maintain positive pressure in the enclosure and is drawn off at exhaust outlet 34 in the shroud. The tundish has four outer walls, two of which are shown as 36 and 38 for maintaining a predetermined volume of molten metal at a specified depth 44 for delivery to the caster molds. The molten metal is delivered to each mold through a nozzle 46 and submerged entry tube 47 at a rate controlled by stopper rod 48. A flux material 50 may be provided for covering the surface of molten metal in the tundish.

According to this invention, the tundish includes a mixing zone 60 defined in part by a first inner wall 62 and a second inner wall 64 both of which extend upwardly from the bottom surface of the tundish cavity to a height at least 40 percent of the specified depth 44 of metal in the tundish. In the preferred embodiment illustrated, outer walls 36 and 38 join opposed ends of first and second inner walls 62 and 64 to form the mixing zone 60. The inner surface 66 of the first and second inner walls is spaced a distance within the range of 20 to 65 cm from the vertical axis of the entry station, preferably within the range of 25 to 50 cm therefrom. Openings 68 and 70 are provided for flow of molten metal from the mixing zone to area 71 above the various nozzles 46 in the tundish. In the preferred embodiment illustrated, openings 68 and 70 extend the complete distance between outer walls 36 and 38 of the tundish. The lower periphery of the openings is defined by the upper edge of the first and second inner walls, respectively. Also in the preferred embodiment, bridge walls 72 and 74 extend downwardly into the molten metal in the same plane as the first and second inner walls. The lower edges of bridge walls 72 and 74 define the upper periphery of openings 68 and 70, respectively. The cross sectional area of each opening 68 and 70 is at least equal to the aggregate cross sectional area of the nozzle opening fed by flow of molten metal therethrough and preferably of significantly greater cross sectional area than the aggregate cross sectional area of said nozzle openings. In the preferred embodiment illustrated, the spacing between the upper edge of the first and second inner walls and the lower edge of the bridge walls is within the range of 5 to 15 cm.

In a process for mixing alloying elements with molten metal in the tundish, the alloying element may be injected in particulate form into the ladle stream at a location intermediate between the ladle and the tundish. Lead in particulate form entrained in an inert gas, preferably argon, has been injected in this manner for making free machining leaded steels on a six strand billet type continuous caster. Injection was carried out continuously at a metered rate so as to be commensurate with the desired concentration of lead in the molten metal. Specifically, flow of steel from the ladle was controlled so as to be substantially equal to the rate of discharge or drainage of steel from the tundish to the continuous caster molds. Lead was continuously injected at a rate calculated to provide a lead concentration within the range of 0.15 to 0.35 percent in the steel. Continuous injection together with the mixing provided by turbulence in the mixing zone of the tundish resulted in significantly improved uniformity and enhanced recovery of lead in a heat of steel made in this manner.

We claim:

1. A process for mixing at least one alloying element with molten metal in a tundish, said alloying element having a density greater than that of said molten metal, said process including pouring molten metal from a ladle into a tundish having outer walls defining a cavity for containing a predetermined volume of said molten metal therein at a specified depth, said tundish being adapted to receive the steam of molten metal from said ladle at an entry station having a vertical axis displaced horizontally from the vertical axis of a first outlet opening of the tundish, adding said alloying element to the molten metal and draining the molten metal from the tundish through said first outlet opening into a casting mold, the improvement in said process for uniformly mixing said alloying element with the molten metal in said tundish which comprises:

pouring molten metal from said ladle into a tundish having a mixing zone directly below said receiving station, said mixing zone including a generally vertical first inner wall extending upwardly from a bottom surface of the tundish cavity to a height which is at least forty percent of the specified depth of molten metal in said tundish, said first inner wall extending transversely to the direction of flow of molten metal from said entry station to said first outlet opening, said first inner wall defining at least a portion of the lower periphery of at least one opening for flow of molten metal from said entry station to said first outlet opening, the lower periphery of each opening in the inner wall being at a height not less than forty percent of the specified depth of molten metal in said tundish, the aggregate cross sectional area of said openings in the first inner wall being not less than the cross sectional area of the first outlet opening, said first inner wall being spaced from the vertical axis of said entry station a distance within the range of 20 to 65 cm in a direction normal to said first inner wall, said mixing zone including another wall essentially parallel to said first inner wall and located substantially the same distance from the vertical axis of said entry station as said first inner wall in a direction normal thereto and remote therefrom, said mixing zone including a pair of spaced generally vertical walls joining said first inner wall and said other wall at opposed ends thereof, injecting said alloying element into the stream of molten metal being poured from the ladle into said tundish, and mixing said alloying element with the molten metal in said mixing zone using the force of said stream from the laddle to create sufficient turbulence to obtain uniform distribution of said alloying element in the metal.

2. The improved process of claim 1 wherein said injection step comprises continuously injecting said alloying element into the stream of metal from the ladle at a rate substantially commensurate with the rate at which metal is drained from the tundish so as to provide the desired concentration of said alloying element in said metal.

3. The improved process of claim 2 wherein said injection step comprises continuously injecting particulate lead entrained in an inert gas into the stream from said ladle and flowing inert gas into an enclosed area surrounding said ladle stream and covering the molten metal in said mixing zone.

* * * * *